United States Patent [19]

Schussler

[11] Patent Number: 4,841,689

[45] Date of Patent: Jun. 27, 1989

[54] TWO-SHELL TELESCOPIC ELEMENT

[75] Inventor: Karl Schussler, Oldenburg, Fed. Rep. of Germany

[73] Assignee: Huppe GmbH, Oldenburg, Fed. Rep. of Germany

[21] Appl. No.: 59,044

[22] Filed: Jun. 8, 1987

[30] Foreign Application Priority Data

Jun. 9, 1986 [DE] Fed. Rep. of Germany ..... 3619393

[51] Int. Cl.[4] ..... E04B 2/82

[52] U.S. Cl. ..... 52/64; 52/240; 52/243.1; 160/197

[58] Field of Search ..... 52/67, 64, 243.1, 240, 52/122; 160/197

[56] References Cited

U.S. PATENT DOCUMENTS

| | | | |
|---|---|---|---|
| 3,327,439 | 6/1967 | Eatough | 52/243.1 |
| 3,341,992 | 9/1967 | Piper | 52/243.1 |
| 3,638,376 | 2/1972 | Howes et al. | 52/243.1 |
| 4,014,137 | 3/1977 | Williams | 52/126.3 |
| 4,034,524 | 7/1977 | Fromme et al. | 52/240 |
| 4,205,498 | 6/1980 | Unayama | 52/243.1 |
| 4,462,192 | 7/1984 | Fisher | 52/243.1 |
| 4,549,380 | 10/1985 | Haab | 52/243.1 |

FOREIGN PATENT DOCUMENTS

| | | | |
|---|---|---|---|
| 717 | 2/1979 | European Pat. Off. | 52/240 |
| 2836126 | 8/1978 | Fed. Rep. of Germany . | |
| 3239485 | 10/1982 | Fed. Rep. of Germany . | |
| 3425484 | 7/1984 | Fed. Rep. of Germany . | |
| 842162 | 6/1981 | U.S.S.R. | 52/67 |

*Primary Examiner*—John E. Murtagh
*Assistant Examiner*—Caroline D. Dennison
*Attorney, Agent, or Firm*—Merchant, Gould, Smith, Edell, Welter & Schmidt

[57] ABSTRACT

Presented is a two-shell telescopic element for a movable partition that has a wall section and a horizontally extendable telescoping part. The cover panels of the telescoping part are disposed on the telescoping part in transversally movable fashion to their principal plane. With extended telescoping part, the cover panels run out formt he overlapping area formed with the cover panels of the wall section and can be brought into an end position aligning with the cover panels of the wall section, transversally to the running planes, by an actuating mechanism.

8 Claims, 9 Drawing Sheets

TWO-SHELL TELESCOPIC ELEMENT

TECHNICAL FIELD

The invention concerns a two-shell telescopic element of a partition consisting of several horizontally movable wall elements, with one wall section with externally lying cover panels on a supporting frame, a telescoping part that is extendable horizontally at one vertical edge of the wall section, with cover panels that overlap, in the retracted position, the cover panels of the wall section and that run in correspondingly parallel-running planes, with an upper and/or lower packing (sealing) strip between the cover panels of the wall and of the telescoping part, and with an actuating mechanism between the cover panels for displacing the telescoping part and the upper and/or lower packing strip.

BACKGROUND OF THE INVENTION

Movable, smooth partitions consisting of several individual wall elements that are suspended in displaceable fashion by means of running rollers in running rails firmly attached to the ceiling. For opening and/or removal of the partition, the individual wall elements are released from a locking means and displaced along the running rail, and stacked in a stacking area. For closing the partition, the wall elements are brought into the plane of the wall arranged tightly against one another and braced by packing strips that are extended out between the wall panels of the wall element against the ceiling and/or the floor. Further provided on one or the other lateral end of the partition is a telescoping element that consists of a wall section and of a telescoping part that is extendable laterally horizontally. The telescoping part, when closing the wall, is extended out horizontally, e.g. against a fixed building wall, in order also to brace the wall elements horizontally against one another and to be able to close the available open gap of the building opening in question in crack-free fashion. Alternatively, the telescoping part is displaced against a stop attached to the adjoining wall section whenever there adjoins, instead of a fixed building wall, another partition or the like that may not be loaded with bracing forces.

Known from the German Offenlegungsschrift No. 34 22 484 (Offenlegungsschrift is a laid open print, published patent application examined only as to obvious defects but not as to patentability.) is a telescoping element of the initially mentioned art, wherewith the externally lying cover panels of the telescoping part overlap the cover panels of the adjoining wall section during the entire telescoping stroke (travel); in particular, the cover panels of the wall section in the telescoped end position. The overlapping joints often times strike demanding users as being disturbing, since they impair the optical harmony of the otherwise smooth partition and their alternation from wall element and shadow joints.

Alternatively known are telescoping elements with which the cover panels of the telescoping part align over the entire telescoping travel with the cover panels of the wall section with which, therefore, when extending the telescoping part, there arises a shadow joint whose width is about equal to the amount of telescoping travel and, therewith, essentially wider than the regular shadow joints of the partition. The particularly wide shadow joint between the wall section and the telescoping part of the telescopic element disturbs the appearance of these types of partition.

Hence, the task for the invention is to further develop a two-shell telescopic element of the initially mentioned art in such fashion that the appearance of a partition is also appealing in the area of the telescoping part and does not interrupt the alternation of wall panels and shadow joints.

SUMMARY OF THE INVENTION

This task is resolved, in the case of the telescopic element of the initially mentioned art, in accordance with the invention by the fact that the cover panels of the telescoping part are disposed on the telescoping part in movable fashion, transversally to their principal plane, with extended telescoping part run out from the overlapping area formed with the cover panels of the wall section and are capable of being moved transversally to the running plane into an end position aligning with the cover panels of the wall section by means of the actuating mechanism.

The advantages of the invention lie particularly in the fact that the cover panels of the telescoping part, in the retracted position and during the telescoping movement, overlap the cover panels of the wall section, therefore are moved in a running plane lying in front of the outer surface of the cover panels. Upon reaching the extended position, the cover panels of the telescoping part leave the overlapping area and are then moved over a desired horizontal distance that corresponds to a desired shadow joint, in a transverse movement, into the plane of the cover panels of the wall section Arising in this fashion—in the area of the telescoping part also—is a stepless, smooth external surface of the partition and a shadow joint whose width is about equal to the width of the other shadow joints present between the wall elements.

Preferentially, the actuating mechanism displays pivot arms capable of being pivoted about axes disposed horizontally and parallel to the cover panels of the telescoping part on the frame for the telescoping part. The cover panels of the telescoping part are then installed on pivot arms and can be pivoted on the pivot arms transversally to their principal plane inwardly or outwardly.

The cover panels of the telescoping part can, for example, be prestressed opposite one another with spring means that pull the two cover panels into the wall panel planes when the cover panels are appropriately released in the extended position of the telescoping part.

The transverse movement of the cover panels of the telescoping part is preferentially controlled by the actuating mechanism which, for horizontal extension of the telescoping part and subsequent vertical extension of the packing strips, lies between the cover panels. This type of actuating mechanism has an externally accessible crank shaft with which an internally located threaded spindle can be driven, with rotation of which a knee linkage displaces itself horizontally, its free end being attached to the telescoping part. If the telescoping part reaches the fully extended position and if the crank and the threaded spindle are further rotated, then the telescoping part comes into contact against a building wall or with a stop firmly attached to the wall part. The bearing sleeve of the knee linkage running over the threaded spindle moves further, however, so that the knee linkage angles out upwardly and downwardly and thereby moves upwardly and/or downwardly corresponding horizontal struts. Located on the horizontal struts are vertical rods in the telescoping part and in the wall section whose upper ends press packing strips against the ceiling and against the floor.

Preferentially disposed on the vertical rods of the telescoping part are cams or contact rollers which, when displacing the vertical rods, come into and/or out of engagement with the cam curves attached to the cover panels. When extending the packing strips, the cams move the cover panels into their surface-flush end position. When retracting the packing strips, the cams then again press the cover panels outwardly back into the running planes.

Advantageous further developments of the invention are characterized by the features of the subclaims.

Explained in more detail in the following with the aid of the drawings are examples of embodiment of the invention.

DETAILED DESCRIPTION OF THE INVENTION

Figure 1:
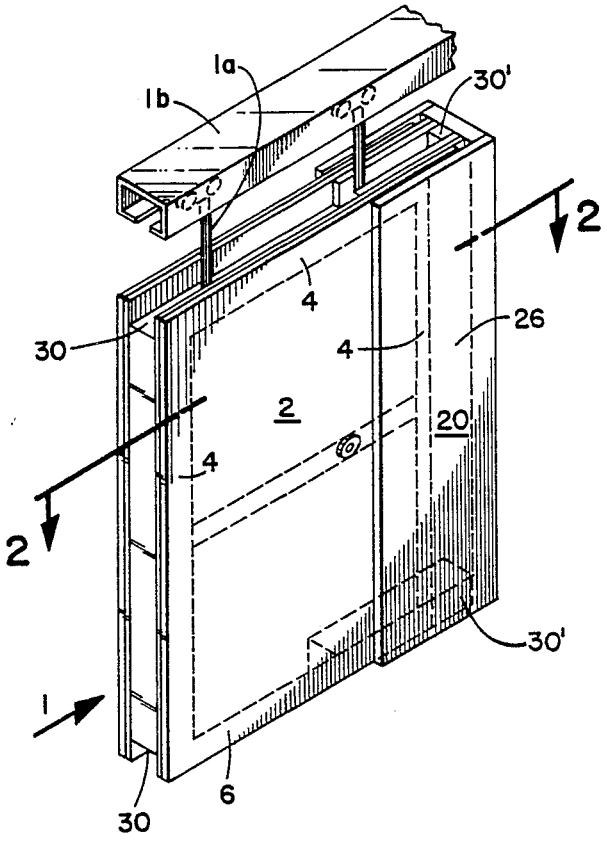
FIG. 1 is an isometric view of a telescopic element with partially extended telescoping part.
Figure 5:
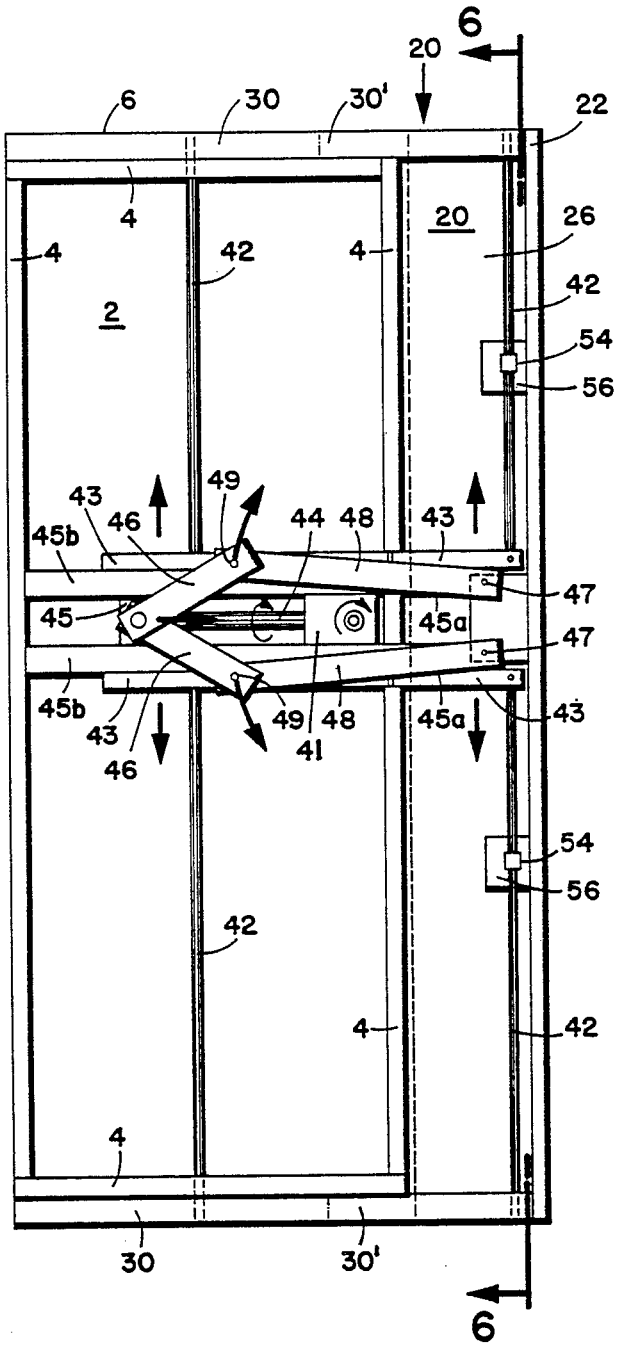
FIG. 5 is a side view of the telescopic element with a cover panel of the wall section and of the telescoping part removed on the front side.

FIG. 1 shows an isometric view of the twos-hell telescopic element 1 that is suspended in longitudinally displaceable fashion on running rollers 1*a* in a ceiling rail 1*b*. The telescopic element 1 has a wall section 2, on the supporting frame 4 of which are attached the running rollers and the cover panels 6 lying externally on both sides. Provided on one vertical edge of the wall section 2 is a telescoping part 20 that extends over the entire height of the wall section 2 and that is capable of being extended out therefrom horizontally over a predetermined stroke of travel. The telescoping part 20 has cover panels 26 that partially overlap the cover panels 6 of the wall section 2 during the telescoping movement and that run in corresponding (appropriate), externally lying, parallel running planes when the telescoping part moves horizontally. Provided between the cover panels 6 of the wall section 2 and the cover panels 26 of the telescoping part 20 are respectively an upper and a lower horizontal packaging strip 30 that can have a section of a packing strip 30' coupled with the telescoping part and subsequently be closely identified with the telescoping part movement. Disposed between the cover panels 6 of wall section 2 is an actuating mechanism 40, compare in particular FIG. 5, that displaces the telescoping part 20 and the packing strips 30 by means of an externally attachable crank shaft, as shown in FIG. 1.

Figure 2:
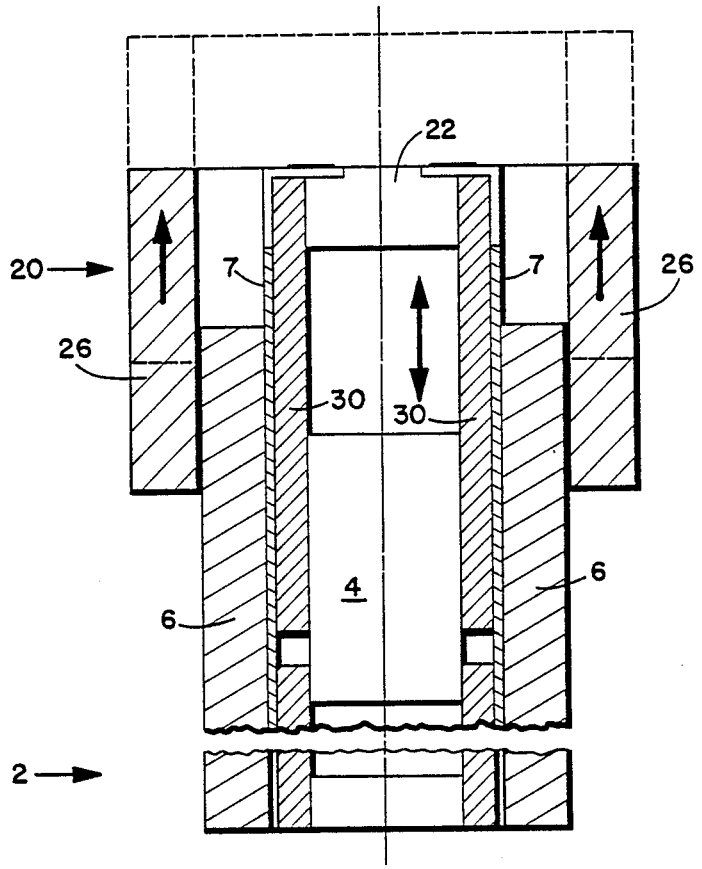
FIG. 2 is a cut along the line II—II of FIG.. 1.
Figure 3:
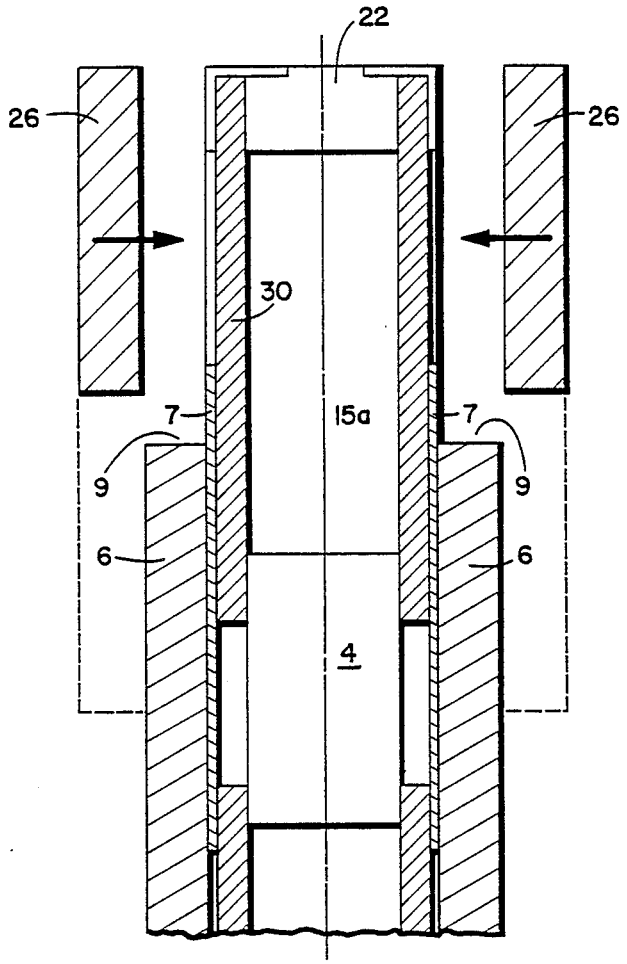
FIG. 3 is a cut along the line II—II of FIG. 1 with completely extended telescoping part, before transverse movement of the telescoping part/cover panels into the surface-flush end location.
Figure 4:
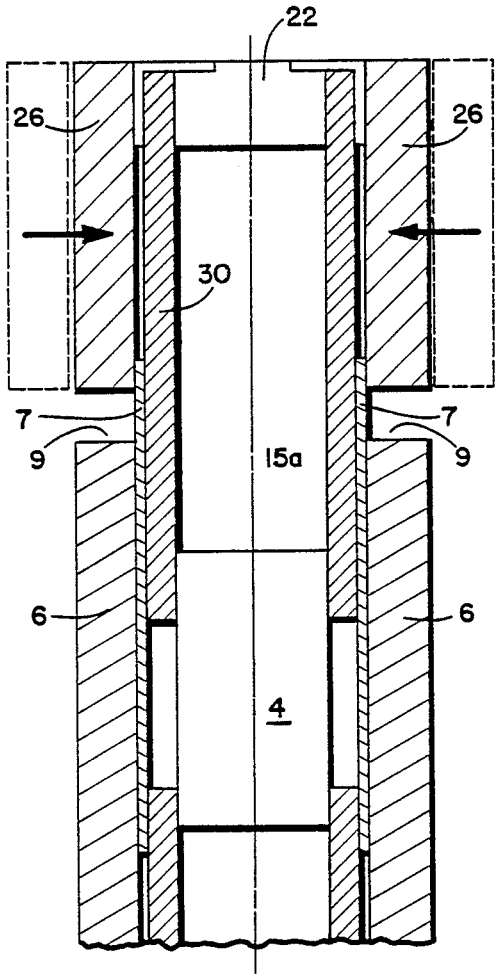
FIG. 4 is a cut along the line II—II of FIG. 1 with completely extended telescoping part, after transverse movement of the telescoping part/cover panels into their surface-flush end location.

FIGS. 2, 3 and 4 show a cut along 3; II—II of FIG. 1 with partially extended telescoping part 20 (FIG. 2) and completely extended telescoping part 20 before and after transverse movement of the cover panels 26 (FIGS. 3 and 4). The cover panels 26 of the telescoping part 20 have, in accordance with these Figures, a horizontal length such that the cover panels 26, with extended telescoping part 20, finally leave the area of overlapping to the extent that the vertical edges of the cover panels 6 of the wall section 2 adjoining one another, and the cover panels 26 of the telescoping part 20, assume a predetermined interval from one another, compare FIG. 3. The cover panels 26 are movably disposed on the frame 22 of the telescoping part 20 and can be moved perpendicularly to their principal plane whenever the actuating mechanism 40—with completely extended telescoping part—releases the cover panels 26 for a movement directed toward one another, compare FIG. 4. The cover panels 26 of the telescoping part 20 then align, in their end position, with the cover panels 6 of the wall section 2. The horizontal length of the cover panels 26 of the telescoping part 20 is preferentially to be dimensioned here such that the shadow joint 9 forming between them and the cover panels of 6 of wall section 2 have the same width as the regular shadow joints between wall elements adjacent to one another. The cover panels 6 of the wall section 2 are backed, on the vertical edges facing toward the cover panels 26 of the telescoping part, with thin masking strips 7 that represent the base of the shadow joints 9. Upon retracting the telescoping part 20, the actuating mechanism 40, compare FIG. 5 to 9, moves the cover panels 26 out from the end location shown in FIG. 4, away from one another, into the position represented in FIG. 3, out from whence the telescoping part 20 can then begin the horizontal movement back into the wall section 2.

Disposed between cover panels 6,26 is an actuating mechanism 40, compare FIG. 5 to 9, that has a crank block 41 with an externally accessible crank shaft, 41*a* a horizontally journalled threaded spindle 44 capable of being driven by the crank shaft, and a knee lever mechanism including link arms 46,48 running over the threaded spindle by means of threaded sleeve 45, the arms 46,48 of said knee lever mechanism running upwardly and downwardly and being coupled with one another in linkage fashion at an upper, respectively lower linkage point by means of an axle 49. The free ends 47 of the arms 48 project in between the cover panels 26 of the telescoping part 20 and are linked to the telescoping part Further provided, attached to the supporting frame 4, are horizontal guides 50 in which are displaceably journalled guide rods 50*a* that are also attached to the telescoping part in order to guide this latter in stable fashion during the telescoping movement.

The hinge axles 49 between the arms 46 and 48 of the knee joint rod are firmly joined with horizontal struts 43, from which lead vertical rods 42 between cover panels 6,26 to the top and bottom packing strips 30 in the telescoping part 20, toward the corresponding sections of the packing strips 30'. When the user actuates the crank block 41, the threaded spindle 44 is rotated, over which, when doing this, the threaded sleeve 45 and the knee joint linkages including arms 46, 48 and axles 49 together with the horizontal struts 43 and the telescopic part 20 extends out horizontally. As soon as the telescoping part 20 runs up against a stop firmly attached to the building or firmly attached to a wall, horizontal movement of the telescoping part 20 stops. With further actuation of the crank drive 41, however, horizontal displacement of the threaded sleeve 45 persists, whereupon the knee joint linkage angles out more strongly upwardly and/or downwardly and, thereby, moves the horizontal struts 43 upwardly and/or downwardly. The movement of the horizontal struts 43 is transfered via the vertical rods 42 over to the packing strips 30 and the sections of packing strip 30' which thereby travel toward the ceiling and/or toward the floor.

Figure 6:
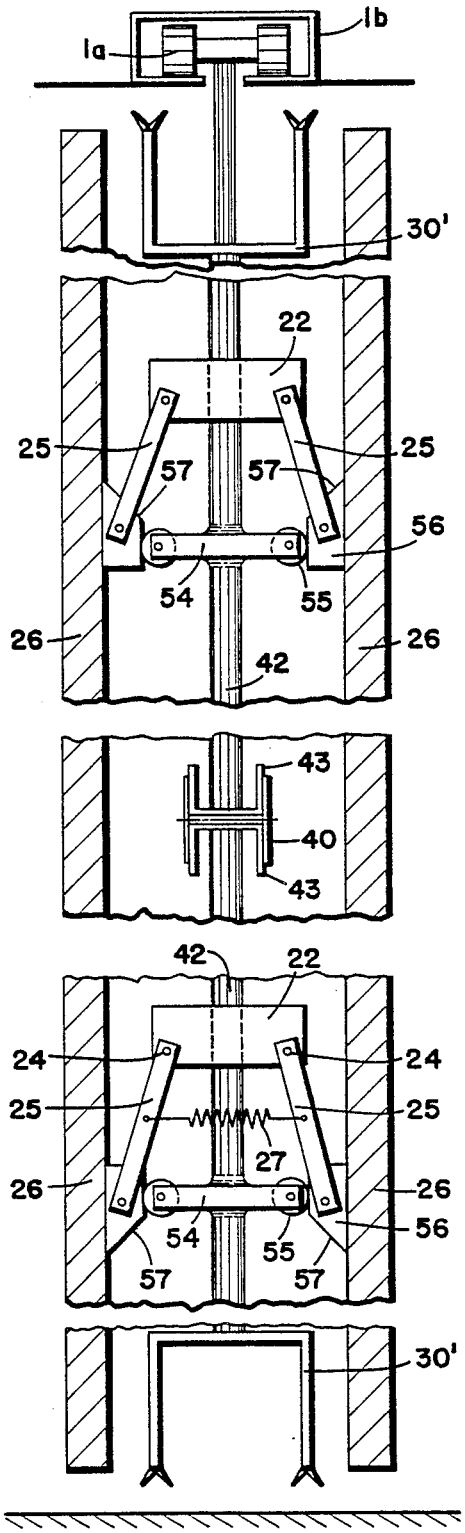
FIG. 6 is a cut along the line V—V of FIG. 4 with completely extended telescoping part, before transverse movement of the telescoping part/cover panels into the surface-flush end location.
Figure 7:
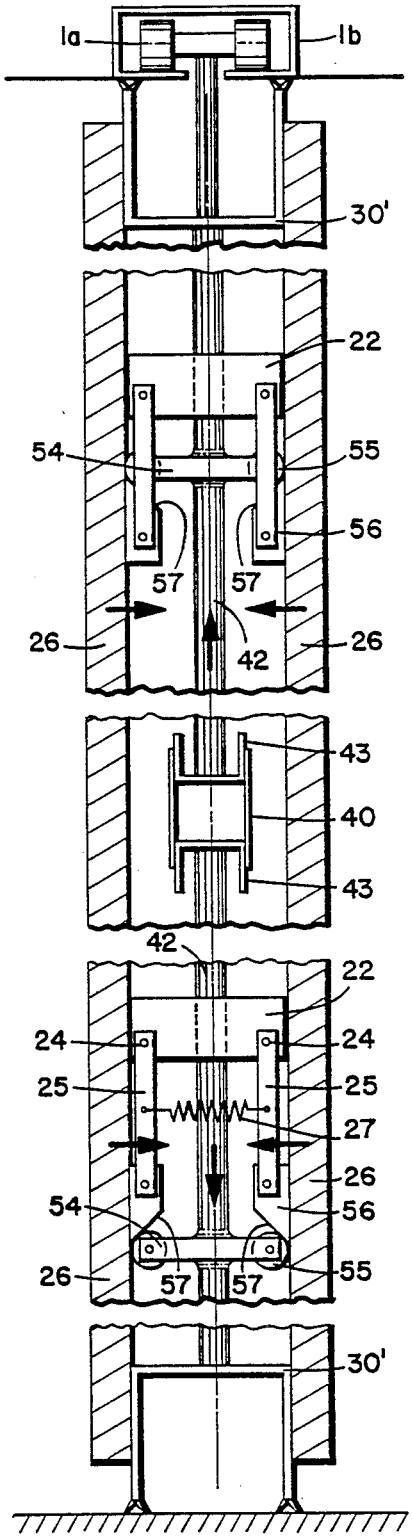
FIG. 7 is the representation in accordance with FIG. 6, however after transverse movement of the telescoping part/cover panels into their surface-flush end location.

According to FIGS. 6 and 7, the cover panels 26 of the telescoping part 20 are linked to pivot arms 25 that are pivotably journalled about horizontal axes 24, with the horizontal axes 24 extending parallel to the cover panels 26 and are attached to the frame 22 of the telescoping part. The cover panels 26 are prestressed opposite to one another by means of a tension spring 27 that is attached to oppositely lying pivot arms 25. Disposed on the vertical rods 42 that are journalled in vertically displaced fashion in the telescoping part 20, at a predetermined height and directed transversally toward the cover panels 26, are cams 54 with external contact rollers 55. Attached to the cover panels 26, at corresponding heights, are counter-cams 56 that serve as guide (control) curves for the cams 54 and/or their contact rollers 55. The counter-cams 56 have cam curves 57 that approach the cover panels 26 wedge-fashion, in the area of cam 54 of the lower vertical rod 42 downwardly.

With the upward movement of the top vertical rod 42 and the simultaneous downward movement of the lower vertical rod 42 triggered by the actuating mechanism 40, cams 54 execute a corresponding upward, respectively a downward movement along the cam curves 57, during the course of which the cover panels 26—under the action of the tension spring 27—executes a transverse movement directed toward one another, out from their position in accordance with FIG. 6 and finally reach their end position in accordance with FIG. 7, in which they align with the cover panels 6 of wall section 2.

If, on the other hand, packing strips 30, 30' are retracted, then the upper vertical rod 42 moves downwardly with the upper packing strip 30, 30', the lower vertical rod 42 moves upwardly with the lower packing strips 30, 30'. This movement is transformed by means of cams 54 and the cam curves 57 of the counter-cams 56 into a transverse movement of the cover panels 26 directed away from one another, which, in this manner, are pivoted out from the position in accordance with FIG. 6 into their running planes in accordance with FIG. 7, in which the cover panels 6 of wall section 2 run parallel to one another in externally overlapping fashion. Then, from this intermediate position, the telescoping part 20 can be cranked back into the wall section 2, whereby the cover panels 26 again overlap with the cover panels 6 of wall section 2.

Figure 8:
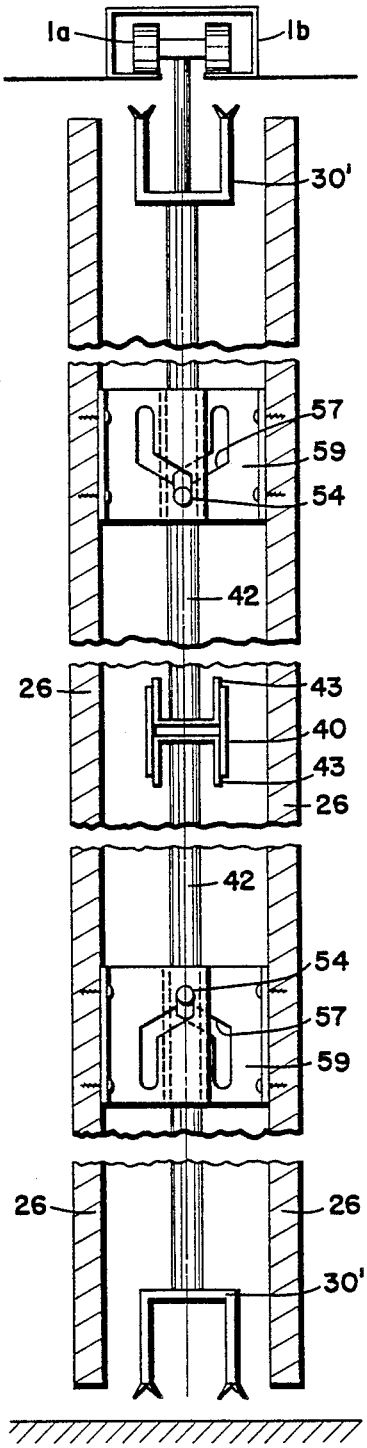
FIG. 8 is a representation corresponding to FIG. 6 for a second form of embodiment.
Figure 9:
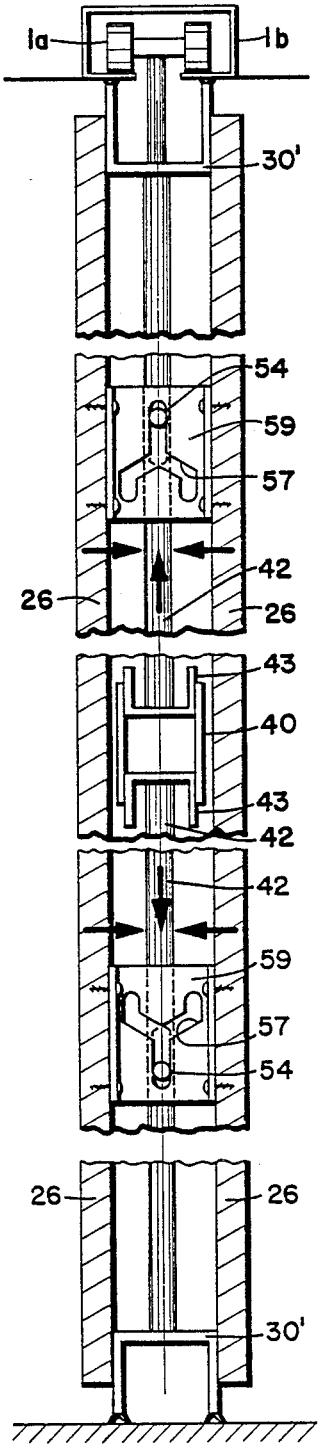
FIG. 9 is a representation corresponding to the one in FIG. 7 of the second form of embodiment.

FIGS. 8 and 9 show two representations corresponding to FIGS. 6 and 7 for another form of embodiment of the invention, whereby, in FIGS. 6–9, the same parts are designated with the same reference numbers. In the form of embodiment according to FIGS. 8 and 9, the cams 54 are constructed as cam pins that are installed parallel to the cover panels 26 on the upper and lower vertical rods 42.

Attached to the inner surface of the cover panels 26—at the level of cams 54—are transverse flanges 59 that are directed toward the adjoining cover panel 26 and display cam curves 57 in the form of cutouts in which cams 54 of the vertical rods 42 are forcefully guided. In the form of embodiment represented, only a single control pin or cam 54 is installed directly on the vertical rods 42, and the associated transverse flange 59 of the two cover panels 26 overlap in the area of cams 54 to the extent that the cams 54 are simultaneously guided in both cam curves 57 of the overlapping transverse flanges 59. The slot-form cam curves 57 in the transverse flanges 59 are formed such that they approach more strongly toward the packing strips on the cover panel 26 to which the transverse flange 59 in question is attached. However, if the vertical rods 42 are extended out from the position in accordance with FIG. 8 with the packing strips 30, 30', against the ceiling and/or the floor, the cover panels 26, under forceful guidance of cams 54 and cam curves 57, are moved toward one another and then assume in their end location a position in accordance with FIG. 9.

What is claimed is:

1. A telescoping wall element for a wall partition, said wall element comprising:

(a) a wall section including external cover panels on a supporting frame; and (b) a telescoping part including cover panels on a supporting frame, said telescoping part extending horizontally from a vertical edge of said wall section, and said telescoping part being movable from a first retracted position to a second extended position, said cover panels overlapping and parallel to said wall section cover panels when said telescoping part is in said first retracted position, and said telescoping part cover panels parallel to and lying in plane with said wall section when said telescoping part is in said second extended position; and (c) at least one packing strip between said wall section cover panels and between said telescoping part cover panels, said packing strip vertically extendable from a first retracted position to a second extended position; and (d) an actuating mechanism for horizontally moving said telescoping part between said first retracted position and said second extended position, and for vertically moving said packing strip from said first retracted position to said second extended position.

2. A wall element according to claim 1, wherein said actuating mechanism of said wall element includes pivot arms that are pivotable about axes disposed horizontally and parallel to said telescoping part cover panels on said telescoping part frame, said telescoping part cover panels pivotally connected to said pivot arms.

3. A wall element according to claim 1, wherein said telescoping part cover panels are biased toward each other with a spring means.

4. A wall element according to claim 3, wherein said spring means contains at least one tension spring that is stretched between said telescoping part cover panels.

5. A wall element according to claim 1, wherein said actuating mechanism includes vertical rods in said wall section and in said telescoping part for displacing said packing strip, wherein said vertical rods include at least one cam which engages at least one cam curve on one of said telescoping part cover panels to displace said vertical rods.

6. A wall element according to claim 5, wherein said cam biases said telescoping part cover panels toward said first, retracted position when said packing strips are biased toward said first, retracted position.

7. A wall element according to claim 5, wherein said telescoping part cover panels include an innerside, said cam curves fixed to said innerside of said telescoping part cover panels, and wherein said cams are directed against said telescoping part cover panels.

8. A wall element according to claim 5, wherein said cams include cam pins, said cam pins running parallel to said cover panels, said cover panels include transverse flanges directed toward and adjoining said cover panels; said cam curves including cut-outs into which said cam pins of said vertical rods are forcibly guided for forcing transverse movement of said cover panels between said first retracted position and said second extended position.

* * * * *

UNITED STATES PATENT AND TRADEMARK OFFICE

CERTIFICATE OF CORRECTION

PATENT NO. : 4,841,689

DATED : June 27, 1989

INVENTOR(S) : Karl Schussler

It is certified that error appears in the above-identified patent and that said Letters Patent is hereby corrected as shown below:

Abstract, line 7
"formt he" should be --from the--.

Col. 1, line 47
"22" should be --25--

Col. 2, line 32
after "section" insert a period

Col. 3, line 51
"twos-hell" should be --two-shell--

Col 4, line 10
delete "3;" and insert --line--

Col. 4, line 49
"shaft, 41a" should be --shaft 41a,--

Col. 5, line 6
"axles" should be --axle--

Signed and Sealed this

Tenth Day of July, 1990

*Attest:*

HARRY F. MANBECK, JR.

*Attesting Officer*

*Commissioner of Patents and Trademarks*